United States Patent [19]

Bishop

[11] 3,934,680

[45] Jan. 27, 1976

[54] SAFETY LATCH FOR AUTOMOTIVE HOISTS OR THE LIKE

[75] Inventor: Burton DeWolfe Bishop, Salisbury, Md.

[73] Assignee: Dresser Industries, Inc., Dallas, Tex.

[22] Filed: Feb. 26, 1975

[21] Appl. No.: 553,366

[52] U.S. Cl. ..... 187/8.5

[51] Int. Cl.[2] ..... B66F 7/28

[58] Field of Search ..... 187/8.41, 8.47, 8.49, 8.5, 187/8.69, 19; 254/6 R, 6 B, 12, 112, 115; 74/533

[56] References Cited

UNITED STATES PATENTS

| | | | |
|---|---|---|---|
| 2,059,059 | 10/1936 | Thompson | 187/8.5 |
| 2,750,004 | 6/1956 | Harrison | 187/8.5 |
| 2,849,084 | 8/1958 | Hott et al | 187/8.5 |

*Primary Examiner*—John J. Love
*Assistant Examiner*—James L. Rowland
*Attorney, Agent, or Firm*—Roy L. Van Winkle

[57] ABSTRACT

The disclosed safety latch is operable with automotive hoists that have a rack gear connected to and movable with the hoist piston. The piston, which carries the hoist superstructure, is disposed in a cylinder so that the piston telescopes to raise and lower the hoist in response to hydraulic or pneumatic pressure acting thereon. A pinion gear mounted on the latch is in engagement with the rack and, through a slip clutch mechanism, drives an operating lever that is connected with a latch dog for securely engaging the rack to prevent movement of the rack and the piston downwardly with respect to the cylinder. The latch operating mechanism can be operated manually to completely disengage the latch dog from the rack whereby the hoist may be lowered. The slip clutch mechanism is provided with a lost motion coupling member between the latch operating member and the latch dog so that the latch dog remains in engagement with the rack should the system for raising the hoist become inoperative.

5 Claims, 7 Drawing Figures

SAFETY LATCH FOR AUTOMOTIVE HOISTS OR THE LIKE

BACKGROUND OF THE INVENTION

This invention relates generally to improvements in automotive hoists or the like. More specifically, the invention relates to an improved safety latch apparatus for automotive hoists.

Numerous approaches have been taken to design safety latches for automotive hoists or lifts. Three of these are illustrated in U.S. Pat. No. 2,059,059 issued to E. B. Thompson on Oct. 27, 1936, U.S. Pat. No. 2,750,004 issued to J. B. Harrison on June 12, 1956, and U.S. Pat. No. 2,849,084 issued to I. V. K. Hott et al on Aug. 26, 1958.

In addition to the above, it has also been relatively common practice to equip the hoist with a tubular member that is attached to the piston of the hoist and thus rises therewith. The tube telescopes within a cylinder or sleeve that is mounted in the ground. Upon reaching the full upper position of the hoist, a pin is simply inserted through the cylinder and the tube to prevent the telescoping of the tube within the cylinder until the pin is removed.

Another approach to the design of safety latches for hoists has been to provide a tube that is hinged on the piston so that it rises with the piston. Upon reaching the uppermost position of the hoist, the tube is pivoted downwardly engaging the surface of the ground to prevent inadvertent downward movement of the hoist.

Each of the foregoing described latches will operate to prevent accidental downward movement of the hoist. Some of the latches are rather complex, resulting in maintenance difficulty and increased cost.

As those skilled in the art will appreciate, some of the prior art latches have the disadvantage of locking only when the hoist is in its uppermost position and, should a failure occur during raising of the hoist, the latch is inoperative. However, some of the aforementioned latches can be utilized at intermediate positions of the hoist, but most must be engaged manually at such intermediate positions.

The improved latch apparatus of this invention is operative during the raising of the hoist and is, in fact, biased into latching engagement by the act of raising the hoist so that no matter when the failure of the hoist power system occurs the latch will immediately engage to prevent downward movement of the hoist.

Further, the improved latch of this invention is relatively simple, thereby reducing maintenance and manufacturing costs.

SUMMARY OF THE INVENTION

This invention provides an improved safety latch apparatus for automotive hoists or the like that includes a piston telescopingly arranged within a fixed cylinder and means for causing the piston to move relative to the cylinder. The latch apparatus comprises: a rack gear attached and movable with the piston; a latch housing attached to the cylinder and encompassing a portion of the rack gear, whereby the rack gear can move through the housing upon movement of the piston; a gear shaft journaled in the housing; a spur gear attached to the gear shaft in mesh with the rack gear, whereby the spur gear and shaft rotate in response to movement of the rack gear through the housing; and, a latch dog member that is pivotally supported by the housing. The latch dog includes a toothed portion that is engageable with the teeth of the rack gear. The latch apparatus also includes a friction clutch means on the gear shaft for automatically urging the latch dog toward the rack gear when the piston is raised relative to the cylinder. The friction clutch means includes a latch operating member movable with and, at other times, movable relative to the spur gear and gear shaft and the clutch means also includes a connecting member extending between the latch operating member and the latch dog member. Resilient means on the latch operating member is provided for biasing the latch dog member relatively toward the rack gear. As arranged, the movement of the operating member moves the latch dog member into and out of engagement with the rack gear to prevent or to permit movement of the rack relative to the housing. The resilient means also permits movement of the dog member relatively away from the rack gear permitting relative upward movement of the rack relative to the housing when the latch dog member is engaged with the rack gear.

The foregoing and additional objects and advantages of the invention will become more apparent as the following detailed description is read in conjunction with the drawing.

DESCRIPTION OF THE PREFERRED EMBODIMENT

Figure 1:
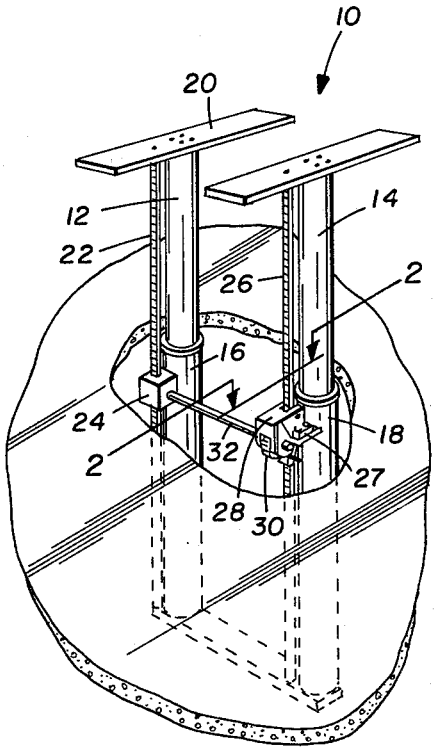
FIG. 1 is a partially cutaway, pictorial view of a hoist including a safety latch apparatus constructed in accordance with the invention.

Referring to the drawing and to FIG. 1 in particular, shown therein and generally designated by the reference character 10 is an automotive hoist constructed in accordance with the invention. The automotive hoist 10 is of the two-post type, that is, it includes identical pistons 12 and 14 that are telescopically arranged with respect to identical cylinders 16 and 18. The cylinders 16 and 18 are positioned below the surface of the ground. Although, not shown, it will be understood that an appropriate system is provided for causing the telescoping of the pistons 12 and 14 within the cylinders 16 and 18.

At the upper end of the pistons 12 and 14 is a superstructure that is generally designated by the reference character 20. The superstructure 20 is provided to engage the underside of the automotive vehicle to be lifted by the hoist 10.

Mounted on the hoist 10, and externally of the piston 12 and cylinder 16, is a rack gear 22. The rack gear 22 is arranged to move with the piston 12 and extends through a housing 24, which is mounted on the cylinder 16. The housing 24 contains a pinion gear (not shown) that is in mesh with the rack gear 22. Similarly, a rack gear 26 is mounted externally of the piston 14 in the cylinder 18. The rack gear 26 is mounted for movement with the piston 14 and extends through a safety latch assembly 27. The latch assembly 27 includes a housing 28 that is mounted on the cylinder 18. The housing 28 has a pinion gear 30 therein that is in mesh with the rack gear 26.

The pinion gear 30 in the housing 28 and the pinion gear in the housing 24 are mounted on a shaft 32 that extends therebetween. The mounting of the two pinion gears on the shaft 30, in mesh with the rack gears 22 and 26, assures that the pistons 12 and 14 move in concert.

The foregoing description makes reference to the two-post hoist 10 as shown in FIG. 1. However, it should be understood that the safety latch apparatus constructed in accordance with the invention herein can be utilized in conjunction with a single-post hoist as well as with the two-post hoist 10 illustrated.

Figure 2:
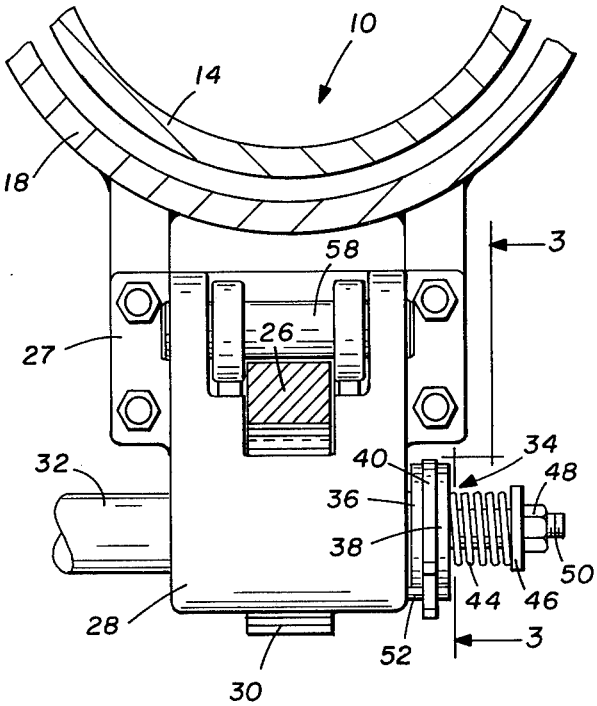
FIG. 2 is a top view of the safety latch apparatus, partially in cross section, taken along the line 2—2 of FIG. 1.
Figure 4:
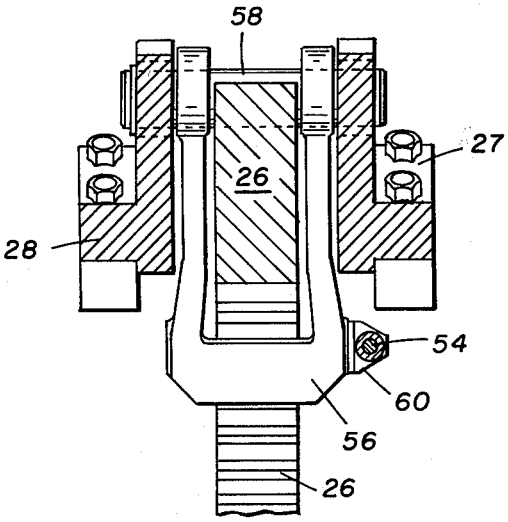
FIG. 4 is a cross-sectional view of the safety latch apparatus taken generally along the line 4—4 of FIG. 3.
Figure 3:
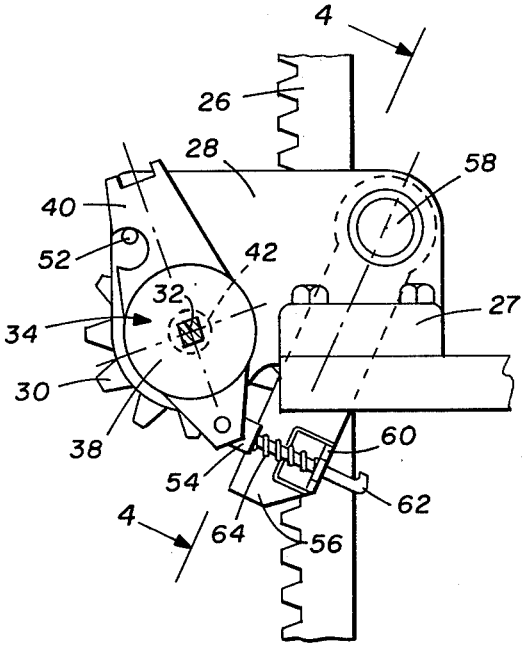
FIG. 3 is a side elevational view, partially in cross section, that is taken generally along the line 3—3 of FIG. 2.

FIGS 2, 3 and 4 show, in more detail, the structure of the safety latch assembly 27. In addition to the housing 28, the pinion gear 30 and the shaft 32, the latch assembly 27 also includes a slip clutch mechanism 34 that is located on one end of the shaft 32. In order to make the slip clutch 34 operate properly, the end of the shaft has been formed into a square as is shown more clearly in FIG. 3. Friction discs 36 and 38 are provided with square holes to fit the end of the shaft 32 so that the discs rotate therewith. Located between the friction discs 36 and 38 is a latch operating member 40 that is provided with a circular hole 42 (see FIG. 3) which is sized to receive the rectangular end of the shaft and to rotate thereon. Since the latch operating member 40 has the circular hole 42, it is not connected to the shaft 32 except frictionally through the friction discs 36 and 38.

Referring again to FIG. 2, it can be seen that a compression spring 44 encircles the shaft 32. The spring 44 has one end disposed in engagement with the friction disc 38 and the opposite end disposed in engagement with a washer 46 that is held in place on the shaft 32 by a threaded nut 48. The end of the shaft 32 is provided with threads 50 to permit the adjustment of the nut 48 inwardly and outwardly to vary the force exerted by the spring 44 on the friction disc 38. The spring 44 thus provides the force to cause the latch operating member 40 to be moved by the friction discs 36 and 38.

Referring to FIG. 3, it can be seen that a stop pin 52 is located in the housing 28 in a position to engage the latch operating member 40. The engagement of the pin 52 in the latch operating member 40 limits the rotational movement of the latch operating member 40 in one direction. Since the clip clutch 34 is provided, the pinion 30 can continue to rotate even though the latch operating member 40 is held from rotating by the stop pin 52.

In FIG. 3, it can also be seen that the lower end of the latch operating member 40 is pivotally connected with an elongated connecting member 54. The connecting member 54 extends from the latch operating member 40 to a generally U-shaped latch dog 56 that is pivotally supported in the housing 28 by a pivot pin 58. The pivot pin 58 is disposed on the side of the rack gear 26 opposite to the teeth thereon so that the latch dog 56 is "overcenter" with respect to the rack gear 26.

The connecting member 54 extends through an opening in a bracket 60 that is mounted on the latch dog 56. The connecting member 54 is slidable with relation to the bracket 60, but is prevented from being moved outwardly therethrough by an enlargement 62 formed on the free end of the connecting member 54. A compression spring 64 encircles the connecting member 54 and is disposed between a shoulder on the connecting member 54 and the bracket 60 to resiliently bias the latch dog 56 relatively toward the rack gear 26.

OPERATION OF THE PREFERRED EMBODIMENT

Figure 5:
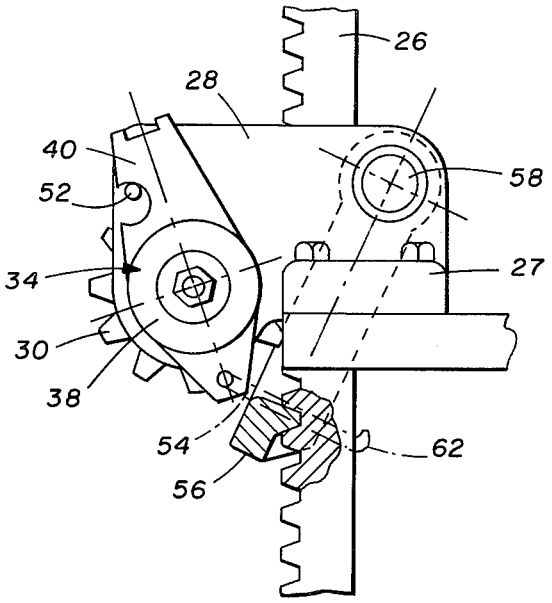
FIG. 5 is a partially broken away view similar to FIG. 3 and illustrating the safety latch mechanism in one operating position.

In operation of the lift 10, a car or other vehicle (not shown) would be placed on or over the superstructure 20. The hoist power system (not shown) is activated to provide fluid to the hoist raising the pistons 12 and 14 relative to the cylinders 16 and 18 and, thus, lifting the vehicle. The safety latch assembly 27 is engaged with the rack 26 by positioning the latch operating member 40 in the position shown in FIGS. 3 and 5.

With the operating member 40 in the position illustrated, the connecting member 54 extends through the bracket 60 on the latch dog 56 so that the compression spring 64 thereon biases the latch dog 56 into engagement with the rack gear 26. In this position, the tooth on the latch dog is in engagement with one of the teeth in the rack gear 26.

As the rack gear 26 moves upwardly with the piston 14, the latch dog 56 is biased relatively away from the rack gear 26 due to the angle of the teeth thereon. Stated in another way, the rack gear 26 "ratchets" upwardly. Such ratcheting action is possible due to the location of the pivot pin 58 on the latch dog 56. In other words, clockwise rotation of the latch dog 56 tends to move the latch dog 56 relatively away from the rack gear 26, but the latch dog 56 engages each tooth of the rack gear 26 placing the safety latch assembly 27 in position to function in the event of a failure of the power system in all positions of the hoist 10.

It will be seen that any attempt of the rack gear 26 to move downwardly causes the latch dog 56 to rotate in a counterclockwise direction about the pivot pin 58 which tends to bring the latch dog 56 into tighter engagement with the rack gear 26 thus locking the rack gear 26 and preventing downward movement of the piston 14.

Figure 6:
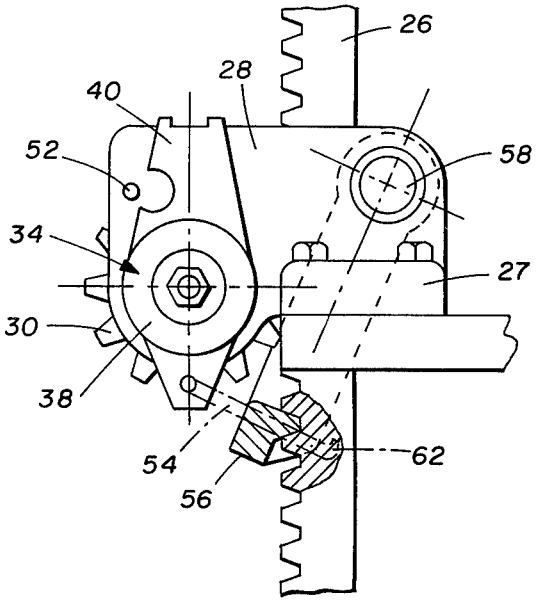
FIG. 6 is a view similar to FIG. 5, but illustrating the safety latch mechanism in still another operating position.

As shown in FIG. 6, the downward movement of the rack gear 26 relative to the cylinder 18 and the safety latch assembly 27, rotates the spur gear 30, which forms part of the safety latch assembly 27, in a clockwise direction and through the slip clutch 34 rotates the latch operating member 40 in a direction to pull the latch dog 56 out of engagement with the rack gear 26. However, it will be noted that considerable distance or "lost motion " is provided between the latch dog 56 and the abutment 62 on the latch connecting member 54. Thus, the "lost motion" permits the latch operating member 40 to rotate slightly in a clockwise direction as shown in FIG. 6 without disengaging the latch dog 56 from the rack gear 26. The length of the lost motion has been designed so that the self-energizing forces between the latch dog 56 and the rack gear 26 occur prior to the engagement of the enlargement 62 on the latch connecting member 54 with the latch dog 56. Accordingly, the latch assembly 27 is constantly engaged with the rack gear 26 and in a position to prevent downward movement of the rack gear 26 in the event of a power failure.

Figure 7:
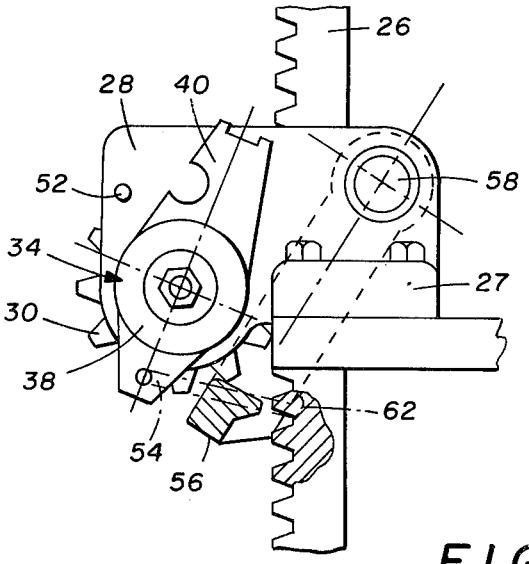
FIG. 7 is also a view similar to FIG. 5, but illustrating the safety latch mechanism in the position that the various parts thereof occupy when the latch is released.

In FIG. 7, the latch operating member 40 has been moved in a clockwise direction until the enlarged portion 62 on the latch connecting member 54 engages the latch dog 56. When this occurs, the latch dog 56 is manually moved out of engagement with the rack gear 26 so that the piston 14 can be lowered relative to the cylinder 18. Stated another way, manual disengagement of the latch dog 56 from the rack gear 26 permits the superstructure 20 and the vehicle mounted thereon to be lowered. It should be pointed out that because of the self-energizing characteristic of the latch dog 56 and the rack gear 26 upon downward movement of the rack gear 26, it may be necessary to move the rack gear 26 slightly upwardly to relieve the load on the latch dog 56 before the latch operating member 40 can be moved to the position illustrated in FIG. 7.

As mentioned earlier, the shaft 32 connects the spur gear 30 in the safety latch assembly 27 with a similar spur gear located in the housing 24 which is mounted on the cylinder 16. Since the gears are mounted on a common shaft, both the pinion 12 and the piston 14 will be lowered or raised simultaneously, thus assuring that the superstructure 20 remains level to prevent dropping the vehicle located thereon.

From the foregoing, it will be apparent that a hoist having an improved safety latch apparatus constructed in accordance with the invention will operate at any elevated stage of the hoist and that such operation is fully automatic not necessitating the manual actuation by the hoist operator after the initial engagement of the safety latch mechanism. The improved safety latch apparatus is relatively simple and requires little or no maintenance during its operating life.

It will also be apparent from the foregoing that the embodiment of safety latch apparatus described in detail hereinbefore is presented by way of example only and that many changes and modifications can be made thereto without departing from the spirit and scope of the invention.

The embodiments of an invention in which an exclusive property or privilege is claimed are defined as follows:

1. Improved safety latch apparatus for automotive hoists or the like that includes a piston telescopingly arranged within a fixed cylinder and means for causing said piston to move relative to said cylinder, said latch apparatus comprising:

a rack gear attached to and movable with the piston;

a latch housing attached to the cylinder and encompassing a portion of said rack gear, whereby said rack gear can move through said housing upon movement of said piston;

a gear shaft journaled in said housing;

a spur gear attached to said gear shaft in mesh with said rack gear, whereby said spur gear and shaft rotate in response to movement of said rack gear through said housing;

a latch dog member pivotally supported by said housing and including a tooth portion that is engageable with said rack gear; and, friction-clutch means on said gear shaft for automatically urging said latch dog toward said rack gear when the piston is raised relative to the cylinder, said friction-clutch means including a latch operating member movable with and, at other times, movable relative to said spur gear and gear shaft, said clutch means also including a connecting member extending between said latch operating member and said latch dog member and resilient means on said latch operating member for biasing said latch dog member relatively toward said rack gear, whereby movement of said operating member moves said latch dog member into or out of engagement with said rack gear to prevent or permit movement of said rack relative to said housing, said resilient means permitting movement of said dog member relatively away from said rack gear permitting relative upward movement of said rack gear relative to said housing when said latch dog member is engaged with said rack gear.

2. The safety latch apparatus of claim 1 wherein the pivotal support for said latch dog is located in said housing toward the side of said rack gear away from the teeth thereon whereby said latch dog, when in engagement with said rack gear, is urged into tighter engagement by a relatively downward force on or movement of said rack gear and is urged out of engagement by a relatively upward movement or force on said rack gear.

3. The safety latch apparatus of claim 1 for use with an automotive hoist having a second piston and second cylinder, said latch apparatus also including:

a second rack gear attached to and movable with the second piston;

a gear housing attached to the second cylinder and encompassing a portion of said second rack gear;

said gear shaft extending through said gear housing and being journaled therein; and, a second spur gear mounted on said gear shaft in mesh with said second rack gear, whereby said first and second piston are constrained to move in concert.

4. The safety latch apparatus of claim 3 wherein said connecting member is longer than the distance from said latch operating member to said latch dog member when said latch operating member is in the position wherein said latch dog member is in engagement with said rack gear, whereby and upon downward movement of said pistion without intentional disengagement of said latch dog member, partial rotation of said spur gear, gear shaft, and latch operating member occurs, said latch dog member securely engages said rack gear stopping the downward movement before said connecting member moves said latch dog member outwardly to an unlatched position.

5. The safety latch apparatus of claim 1 wherein said friction-clutch means also includes:

a pair of friction members mounted for movement with said shaft and disposed on either side of said latch operating member;

said latch operating member being rotatably positioned on said shaft; and, biasing means on said shaft holding said friction member in frictional engagement with said latch operating member, whereby said latch operating member tends to rotate with said spur gear and shaft, but can be moved independently by overcoming the frictional force exerted by said friction members.

* * * * *